US009670694B2

(12) United States Patent
Larson et al.

(10) Patent No.: US 9,670,694 B2
(45) Date of Patent: Jun. 6, 2017

(54) RESTRICTED RANGE LOCKBOX, ACCESS DEVICE AND METHODS

(75) Inventors: Wayne F. Larson, Salem, OR (US); Adam Kuenzi, Salem, OR (US); Jeff Antrican, Salem, OR (US); Teri Lynné Briskey, Monmouth, OR (US)

(73) Assignee: UTC FIRE & SECURITY AMERICAS CORPORATION, INC., Bradenton, FL (US)

( * ) Notice: Subject to any disclaimer, the term of this patent is extended or adjusted under 35 U.S.C. 154(b) by 1750 days.

(21) Appl. No.: 11/963,992

(22) Filed: Dec. 24, 2007

(65) Prior Publication Data

US 2008/0252415 A1 Oct. 16, 2008

Related U.S. Application Data

(60) Provisional application No. 60/923,395, filed on Apr. 12, 2007.

(51) Int. Cl.
*E05B 19/00* (2006.01)
*G07C 9/00* (2006.01)

(52) U.S. Cl.
CPC ..... *E05B 19/0005* (2013.01); *G07C 9/00309* (2013.01)

(58) Field of Classification Search
USPC ..... 340/5.73
See application file for complete search history.

(56) References Cited

U.S. PATENT DOCUMENTS 4,064,558 A 12/1977 Hughes et al.
4,310,720 A 1/1982 Check, Jr.
4,369,434 A 1/1983 Mueller
4,616,111 A 10/1986 Vasquez
4,681,504 A 7/1987 Welch, Sr.
4,697,171 A 9/1987 Suh
4,727,368 A 2/1988 Larson et al.
4,760,393 A 7/1988 Mauch
(Continued)

FOREIGN PATENT DOCUMENTS

CA 1338941 2/1997
CN 1296112 A 5/2001
(Continued)

OTHER PUBLICATIONS

Ardiri, Aaron, "Palm OS® Platform Software Protection," retrieved from http://oasis.palm.com/dev/kb/papers/2169.cfm (18 pages) (printed May 16, 2002).
(Continued)

*Primary Examiner* — Fekadeselassie Girma
(74) *Attorney, Agent, or Firm* — Cantor Colburn LLP

(57) ABSTRACT

A lockbox includes a housing, a key storage area and a lockbox circuit. The key storage area is shaped to receive a stored key and is attached to or positioned within the housing. The key storage area is secured with a lock mechanism to prevent unauthorized access to the stored key. The lockbox circuit comprises a transceiver operable by a magnetically induced current generated by a closely positioned radio access device that can send and receive signals. The circuit is configured to unlock the key storage area upon determining that an access request is authorized to providing access to the stored key. Methods of operation are also disclosed.

6 Claims, 5 Drawing Sheets

(56) References Cited

U.S. PATENT DOCUMENTS 4,766,746 A 8/1988 Henderson et al.
4,791,669 A 12/1988 Kage
4,808,993 A 2/1989 Clark
4,831,851 A 5/1989 Larson
4,851,652 A 7/1989 Imran
4,887,292 A 12/1989 Barrett et al.
4,887,296 A 12/1989 Horne
4,896,246 A 1/1990 Henderson et al.
4,897,875 A 1/1990 Pollard et al.
4,914,732 A 4/1990 Henderson et al.
4,916,443 A 4/1990 Barrett et al.
4,926,665 A 5/1990 Stapley et al.
4,929,880 A 5/1990 Henderson et al.
4,947,163 A 8/1990 Henderson et al.
4,988,987 A 1/1991 Barrett et al.
4,993,069 A 2/1991 Matyas et al.
5,007,089 A 4/1991 Matyas et al.
5,046,084 A 9/1991 Barrett et al.
5,107,258 A 4/1992 Soum
5,131,038 A 7/1992 Puhl et al.
5,140,317 A 8/1992 Hyatt, Jr. et al.
5,202,922 A 4/1993 Iijima
5,245,652 A 9/1993 Larson et al.
5,253,294 A 10/1993 Maurer
5,267,460 A 12/1993 Burleigh
5,280,518 A 1/1994 Danler et al.
5,313,521 A 5/1994 Torii et al.
5,319,710 A 6/1994 Atalla et al.
5,321,242 A 6/1994 Heath, Jr.
5,322,992 A 6/1994 Castleman et al.
5,340,968 A * 8/1994 Watanabe et al. ..... 235/380
5,373,282 A 12/1994 Carter
5,381,478 A 1/1995 Iijima
5,397,884 A 3/1995 Saliga
5,410,301 A 4/1995 Dawson et al.
5,437,057 A 7/1995 Richley et al.
5,451,757 A 9/1995 Heath, Jr.
5,475,375 A 12/1995 Barrett et al.
5,506,575 A 4/1996 Ormos
5,539,824 A 7/1996 Bjorklund et al.
5,541,581 A 7/1996 Trent
5,563,579 A 10/1996 Carter
5,598,476 A 1/1997 LaBarre et al.
5,602,536 A 2/1997 Henderson et al.
5,602,918 A 2/1997 Chen et al.
5,612,668 A 3/1997 Scott
5,612,683 A 3/1997 Trempala et al.
5,654,696 A 8/1997 Barrett et al.
5,705,991 A 1/1998 Kniffin et al.
5,706,347 A 1/1998 Burke et al.
5,708,716 A 1/1998 Tisdale et al.
5,710,557 A 1/1998 Schuette
5,719,938 A 2/1998 Haas et al.
5,729,609 A 3/1998 Moulart et al.
5,745,044 A 4/1998 Hyatt, Jr. et al.
5,751,813 A 5/1998 Dorenbos
5,758,522 A 6/1998 York
5,768,921 A 6/1998 Hill
5,774,058 A 6/1998 Henry et al.
5,778,256 A 7/1998 Darbee
5,791,172 A * 8/1998 Deighton et al. ..... 70/63
5,801,618 A 9/1998 Jenkins
5,801,628 A 9/1998 Maloney
5,815,557 A 9/1998 Larson
5,878,613 A 3/1999 Tabacchi et al.
5,881,584 A 3/1999 Brunoski et al.
5,905,798 A 5/1999 Nerlikar et al.
5,909,491 A 6/1999 Luo
5,937,065 A 8/1999 Simon et al.
5,942,985 A 8/1999 Chin
5,953,425 A 9/1999 Selker
5,960,086 A 9/1999 Atalla
5,987,139 A 11/1999 Bodin
5,999,095 A 12/1999 Earl et al.
6,005,487 A 12/1999 Hyatt, Jr. et al.
6,041,408 A 3/2000 Nishioka et al.
6,044,155 A 3/2000 Thomlinson et al.
6,046,558 A 4/2000 Larson et al.
6,047,575 A 4/2000 Larson et al.
6,065,880 A 5/2000 Thompson
6,072,402 A 6/2000 Kniffin et al.
6,075,441 A 6/2000 Maloney
6,075,864 A 6/2000 Batten
6,088,450 A 7/2000 Davis et al.
6,094,487 A 7/2000 Butler et al.
6,097,306 A 8/2000 Leon et al.
6,130,621 A 10/2000 Weiss
6,151,676 A 11/2000 Cuccia et al.
6,157,720 A 12/2000 Yoshiura et al.
6,167,137 A 12/2000 Marino et al.
6,182,220 B1 1/2001 Chen et al.
6,195,005 B1 2/2001 Maloney
6,204,764 B1 3/2001 Maloney
6,209,367 B1 4/2001 Hyatt, Jr. et al.
6,230,269 B1 5/2001 Spies et al.
6,232,876 B1 5/2001 Maloney
6,243,811 B1 6/2001 Patel
6,262,664 B1 7/2001 Maloney
6,263,435 B1 7/2001 Dondeti et al.
6,269,445 B1 7/2001 Nishioka et al.
6,275,936 B1 8/2001 Kyojima et al.
6,317,044 B1 11/2001 Maloney
6,330,816 B1 * 12/2001 O'Connor ..... 70/63
D456,852 S 5/2002 Maloney
6,392,543 B2 5/2002 Maloney
6,407,665 B2 6/2002 Maloney
6,411,212 B1 6/2002 Hecht et al.
6,424,260 B2 7/2002 Maloney
6,427,913 B1 8/2002 Maloney
6,472,973 B1 * 10/2002 Harold et al. ..... 340/5.73
6,501,379 B2 12/2002 Maloney
6,538,560 B1 3/2003 Stobbe et al.
6,693,538 B2 2/2004 Maloney
6,707,380 B2 3/2004 Maloney
6,727,801 B1 4/2004 Gervasi et al.
6,727,817 B2 4/2004 Maloney
6,803,882 B2 * 10/2004 Hoetzel ..... 343/713
6,813,777 B1 * 11/2004 Weinberger et al. ..... 725/76
6,822,553 B1 * 11/2004 Henderson et al. ..... 340/5.73
6,839,838 B2 1/2005 Fukuda
6,867,695 B2 3/2005 Prado et al.
6,937,140 B1 8/2005 Outslay et al.
7,061,367 B2 6/2006 Mosgrove et al.
7,086,258 B2 8/2006 Fisher et al.
7,123,127 B2 10/2006 Mosgrove et al.
7,128,274 B2 10/2006 Kelley et al.
7,239,238 B2 * 7/2007 Tester et al. ..... 340/539.31
7,340,400 B2 * 3/2008 McGinn et al. ..... 705/317
7,386,876 B2 6/2008 Kim
7,606,558 B2 10/2009 Despain et al.
8,164,419 B2 * 4/2012 Fisher ..... 340/5.73
2001/0022552 A1 9/2001 Maloney
2001/0025340 A1 9/2001 Marchant
2002/0075154 A1 6/2002 Maloney
2002/0145520 A1 10/2002 Maloney
2002/0153418 A1 10/2002 Maloney
2003/0030543 A1 * 2/2003 Castle et al. ..... 340/5.74
2003/0231103 A1 * 12/2003 Fisher ..... 340/5.73
2004/0025039 A1 * 2/2004 Kuenzi et al. ..... 713/193
2004/0212493 A1 * 10/2004 Stilp ..... 340/531
2007/0018787 A1 * 1/2007 Martinez de Velasco Cortina et al. ..... 340/5.61
2007/0018789 A1 * 1/2007 Yuhara ..... 340/5.72
2007/0024417 A1 * 2/2007 Gerstenkorn ..... 340/5.61
2007/0090921 A1 * 4/2007 Fisher ..... 340/5.73
2007/0159297 A1 * 7/2007 Paulk et al. ..... 340/5.73
2008/0252461 A1 * 10/2008 Sugata et al. ..... 340/572.7
2010/0011418 A1 1/2010 Despain et al.
2011/0053557 A1 3/2011 Despain et al.

FOREIGN PATENT DOCUMENTS

DE 4444913 A1 6/1995
DE 19644052 A1 5/1998

(56) References Cited

FOREIGN PATENT DOCUMENTS

| | | | |
|---|---|---|---|
| DE | 29904431 | U1 | 5/1999 |
| EP | 0086617 | A2 | 8/1983 |
| EP | 0086617 | B1 | 8/1983 |
| EP | 0410024 | A1 | 1/1991 |
| EP | 0410024 | B1 | 1/1991 |
| EP | 0427188 | A2 | 5/1991 |
| EP | 0427188 | A3 | 5/1991 |
| EP | 0427188 | B1 | 5/1991 |
| EP | 0668421 | A1 | 8/1995 |
| EP | 0719899 | A1 | 7/1996 |
| EP | 0911475 | A1 | 4/1999 |
| EP | 0911475 | B1 | 4/1999 |
| EP | 0935041 | A1 | 8/1999 |
| EP | 1088958 | A2 | 4/2001 |
| EP | 1088958 | A3 | 4/2001 |
| FR | 2566823 | A1 | 1/1986 |
| FR | 2593310 | A1 | 7/1987 |
| FR | 2705116 | A1 | 11/1994 |
| FR | 2760874 | A1 | 9/1998 |
| GB | 2080383 | A | 2/1982 |
| GB | 2280709 | A | 2/1995 |
| GB | 2305214 | A | 4/1997 |
| GB | 2315804 | A | 2/1998 |
| JP | 7-229336 | | 8/1995 |
| JP | 10-54166 | | 2/1998 |
| JP | 11-71943 | | 3/1999 |
| JP | 2001-182388 | | 7/2001 |
| JP | 2002-256748 | | 9/2002 |
| NL | 8501907 | | 8/1987 |
| NL | 191268 | | 11/1994 |
| RU | 2186919 | C1 | 8/2002 |
| WO | WO8705069 | A1 | 8/1987 |
| WO | WO 90/10134 | | 9/1990 |
| WO | WO 94/17268 | | 8/1994 |
| WO | WO 99/39066 | | 8/1999 |
| WO | WO 01/20413 | | 3/2001 |
| WO | WO 01/25570 | | 4/2001 |
| WO | WO 01/86098 | | 11/2001 |
| WO | WO 02/45031 | | 6/2002 |
| WO | WO 03/093997 | | 11/2003 |

OTHER PUBLICATIONS

DisplayKEY, www.supra-products.com/verticals/realestate/products/displaykey.asp, (1 page) (printed Jan. 25, 2003).

iButton Products: iButtons, www.ibutton.com/products/ibuttons.html, (3 pages) (printed Nov. 13, 2003).

ISO/IEC 18092, "Information technology—Telecommunications and information exchange between systems—Near Field Communication—Interface and Protocol (NFCIP)," (66 pages) (Apr. 1, 2004).

KeyTrak, www.keytrak.com/markets/auto_features.asp, (18 pages) (printed Jan. 15, 2003).

NFC Forum News Conference, Powerpoint presentation (36 pages) (Jun. 5, 2006).

Rinnai Operation/Installation Manual, (48 pages) (Printed in Japan, Jun. 2003).

The extended European Search Report in counterpart European Application No. 08154226 filed Apr. 9, 2008.

* cited by examiner

RESTRICTED RANGE LOCKBOX, ACCESS DEVICE AND METHODS

CROSS REFERENCE TO RELATED APPLICATION

This application claims the benefit of U.S. Provisional Application No. 60/923,395, filed Apr. 12, 2007, which is hereby incorporated by reference.

FIELD

This application relates to lockboxes, and more specifically to using restricted range wireless communications, between a lockbox and an access device.

BACKGROUND

Lockboxes are typically used to a provide a secured storage area for a key or other access aid at a location close to a locked property accessible by the key. In this way, an authorized user can unlock the secured storage area, obtain the key and then use the key to unlock the locked property.

The locked property may be a home or other property that is locked while unattended by a traditional lock that requires a key. In other situations, the locked property may be a commercial or industrial site, or other type of property.

The lockbox is typically attached to a door handle or to another stationary object near the traditional lock. The lockbox is typically configured to require the user to demonstrate that he is authorized to obtain access to the locked property before the secured storage area is unlocked to allow the user to obtain the key. In a mechanical lockbox, the user might be required to enter a correct lock combination to access the secured storage area. In an electronic lockbox, the user might be required to communicate a credential to the lockbox (via a physical connection to the lockbox or via a wireless link to the lockbox) to access the secured storage area.

Conventional electronic lockboxes allow users to communicate their credentials wirelessly via the IrDa standard, i.e., by using infrared signals generated by the user's cellular telephone or personal digital assistant and directed toward the lockbox. In addition, information is typically communicated in the other direction, i.e., from the lockbox to the access device. Also, the lockbox and/or the access device may have other communications links, such as with a central authorization authority that issues credentials to users and collects information from lockboxes on access activity. Infrared communications require line of sight alignment, which is often inconvenient.

Other lockbox approaches use far-field RF communications, but these can lead to problems with interference, excessive power drain, regulatory concerns, difficulty in addressing only a specific desired lockbox among multiple lockboxes located in close proximity and higher component and maintenance costs.

SUMMARY

It would be desirable to provide a lockbox, lockbox and access device system and associated methods that address some of the problems of the prior art. It would be desirable to provide a lockbox with restricted range wireless communications capability, such as within about 30 cm or even about 15 cm, that is reliable, is convenient to operate and provides improved security.

According to one implementation, a lockbox includes a housing, a key storage area and a lockbox circuit. The key storage area is shaped to receive a stored key and is attached to or positioned within the housing. The key storage area is secured with a lock mechanism to prevent unauthorized access to the stored key. The lockbox circuit comprises a transceiver operable by a magnetically induced current generated by a closely positioned radio access device that can send and receive signals. The circuit is configured to unlock the key storage area upon determining that an access request is authorized to providing access to the stored key.

According to another implementation, a lockbox and access device system comprises a lockbox with a key storage area shaped to store a key, a lock mechanism actuatable to secure the key storage area and a circuit coupled to the lock mechanism and responsive to wireless signals within the near field region, an access device capable of near field region communication with the lockbox by magnetically inducing a current within the lockbox circuit to request access to the key storage mechanism and a networked authorization authority linkable with the access device to receive information about a user of the device and to send an authorization to the device.

According to another implementation, a lockbox with restricted range wireless communication capability comprises a housing, a key storage area shaped to receive a stored key, the key storing area being attached to or positioned within the housing and secured with a lock mechanism to prevent unauthorized access to the stored key, a lockbox circuit comprising a transceiver that can send communications to and receive communications a device within a restricted range of less than about 15 cm, the circuit being configured to unlock the key storage area upon receipt of a predetermined unlock signal, thereby providing access to the stored key.

According to another implementation, a lockbox comprises a lockbox housing, a key storage area within the lockbox housing, the key storage area having a locking mechanism for controlling access to the key storage area, a loop antenna physically coupled to the lockbox housing, an NFC transceiver coupled to the loop antenna, a controller coupled to the NFC transceiver and an opening circuit coupled between the controller and the locking mechanism of the key storage area for opening the key storage area in response to a request from the controller.

According to another implementation, a method of controlling a lockbox, comprises receiving electrical power from an access device through inductive coupling, using the received electrical power to activate an NFC transceiver positioned within the lockbox, and communicating wirelessly between the NFC transceiver and the access device to receive a command from the access device relating to the lockbox.

DETAILED DESCRIPTION

Figure 1:
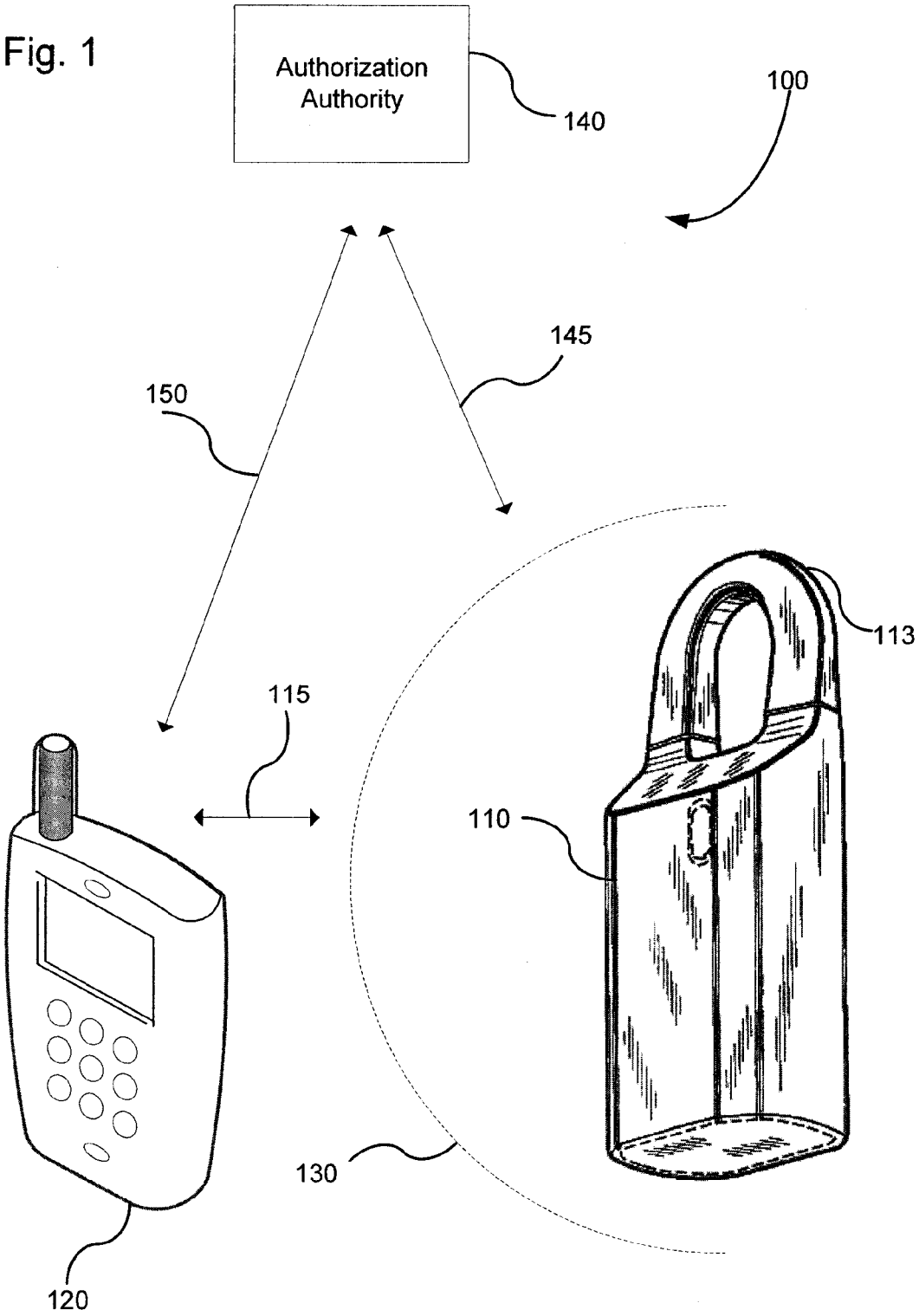
FIG. 1 is a schematic of a lockbox and access device configured for restricted range wireless communication, which also shows a remote authorization entity that may be linked to the lockbox and/or the access device.

Disclosed below are representative embodiments of a lockbox that should not be construed as limiting in any way. Instead, the present disclosure is directed toward all novel and nonobvious features and aspects of the various disclosed methods, apparatus, and equivalents thereof, alone and in various combinations and subcombinations with one another. The disclosed technology is not limited to any specific aspect or feature, or combination thereof, nor do the disclosed methods and apparatus require that any one or more specific advantages be present or problems be solved.

As used in this application and in the claims, the singular forms "a," "an" and "the" include the plural forms unless the context clearly dictates otherwise. Additionally, the term "includes" means "comprises." Moreover, unless the context dictates otherwise, the term "coupled" means physically connected or electrically or electromagnetically connected or linked and includes both direct connections or direct links and indirect connections or indirect links through one or more intermediate elements.

Although the operations of some of the disclosed methods and apparatus are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed methods and apparatus can be used in conjunction with other methods and apparatus.

Described below is a lockbox with restricted range communications capability that does not require line of sight alignment. In specific implementations, the lockbox has a key storage area, which is typically positioned within or attached to a housing of the lockbox and is sized to store a key or other access aid (e.g., a card). The key storage area has a cover (e.g., door) that is locked or secured with a lock mechanism. According to some implementations, the lockbox has a circuit responsive to wireless communications from an access device within the working restricted range of the lockbox. The circuit is configured to provide access to the stored key, such as by unlocking the lock mechanism or other action, when an authorized request for access is received from the access device.

The lockbox includes a transceiver (if implemented for two-way communication) or a receiver (if implemented for one-way communication), and an appropriate antenna. The lockbox circuit also includes logic or a controller that controls and coordinates the operation of the lockbox and a lock mechanism activation portion operable to energize or otherwise enable operation of the lock mechanism. One function of the logic or controller is to process information from the access device representing an identity of a user seeking access (such as a credential), determine whether access is authorized, and, depending upon that determination, either grant access (i.e., by unlocking the lock mechanism) or deny access (i.e., by maintaining the lock mechanism in a locked state). In some embodiments, the lockbox circuit includes a real time clock and a battery for the real time clock. In some embodiments, power for the lockbox circuit is provided by the access device and the lockbox does not have a battery for providing a primary source of power. In some embodiments, the lockbox circuit includes a memory and/or a display or other type of indicator.

The access device, also called a "key" or "electronic key," may be a cellular telephone, "smart" phone or other type of telephone (hereinafter "phone"), personal digital assistant (PDA) or other personal electronic device with restricted range communication capability. A dedicated access device, i.e., a device having a primary function of communicating with lockboxes, may also be used. Although this application is primarily concerned with restricted range wireless communications between the access device and the lockbox not limited to line of sight alignment, the lockbox may also support other forms of communication, such as WiFi, Bluetooth, IrDA, etc., to allow other forms of access devices to be used in the system.

Conventional technologies are not well suited to providing a restricted range yet easy to use and secure lockbox. Bluetooth wireless technology was designed to replace cables between cell phones, laptops, and other computing and communication devices within a 10-meter range. Wi-Fi technology was designed and optimized for Local Area Networks (LAN). Wi-Fi provides an extension or replacement of wired networks for dozens of computing devices within a +100-meter range. ZigBee wireless technology is a standard enabling control and monitoring capabilities for industrial and residential applications within a +100-meter range. IrDA technology is a short range (<1 meter), line-of-sight communication standard for exchange of data over infrared light. IrDA interfaces are frequently used in computers, and in some mobile phones (at least currently). RFID (Radio Frequency Identification) is an automatic identification method, relying on storing and remotely retrieving data using devices called RFID tags. An RFID tag is a small object that can be attached to or incorporated into a product. RFID tags contain silicon chips to enable them to receive and respond to queries from an RFID reader/writer.

Lockbox Environment

Using a restricted range wireless technology in the lockbox environment overcomes a number of deficiencies in current technologies and offers several advantages.

Conventional lockboxes that establish an electrical connection by physical contact are sometimes unreliable and are less convenient.

One conventional wireless approach using infrared communication (such as according to IrDa) requires line of sight alignment. Current infrared lockboxes, such as the GE Security iBox 1692, may consume more power over the life of the lockbox because it must wake up from a sleep mode at periodic intervals and monitor for incoming infrared signals.

Other conventional wireless approaches, such as far-field RF communications, also must wake up and monitor for signals at periodic intervals. In addition, far-field communications require a relatively high current even when the lockbox is in a sleep mode, which consumes battery power more quickly than desired. If larger batteries are used, then larger devices and larger antennas may also be required. In general, conventional systems require that lockbox and the access device each has its own source of power, which increases initial expense and maintenance costs.

Conventionally, pairing an access device to a lockbox can require several manual steps, which is inefficient. Far-field RF communications and Bluetooth have greater operating ranges, leading to a higher risk that communications will be intercepted. In addition, technologies with greater operating ranges cause pairing problems when a user is attempting to access one lockbox where several others are located nearby. One pairing problem is correctly addressing only one lockbox among several that are located in close proximity to each other. Another pairing problem is avoiding inadvertently accessing another lockbox, because it is located within the extended range, such that an unauthorized person might gain access.

Also, far-field RF can be subject to interference and may be subject to regulation at higher power. Far-field radio communications refer to those between an antenna emitting radiating radio waves and a device receiving those waves. According to one definition, the far-field is defined as a separating distance between two devices in communication (such as a lockbox and an access device) exceeding more than one wavelength of the radio signal. Far-field signals decay as the square of the distance from the antenna.

Alternatively, radio communications can be carried out in a near field region where the devices are positioned much closer together than in far field communications. Near field communications, according to one definition, occur within a separating distance less than one wavelength. According to another definition, the boundary of the near field region is located at a distance of $c=2\Pi f$, where f is the frequency of the alternating current field generated by the transmitting device. In the near field region, the magnetic field lines of one device interact with those of the other device, thus allowing the transmitting device to magnetically induce an electric current in the receiving device. This near field signal decays as the cube of the distance from the antenna, and thus decays even more rapidly than far-field signal strength.

Thus, a lockbox and access device capable of magnetically induced coupling within the near field region is one example of a restricted range system providing advantages over conventional approaches. Because the near field region exists only at a limited distance between the lockbox and the access device, the access device must be positioned close to the lockbox for communications, which enhances the privacy of the communications. At the same time, the access device need not be aligned along a precise direction with the lockbox, as is the case with infrared communications. Also, because the near field signal decays so rapidly with increasing distance, there is a much reduced chance of inadvertent communication with other nearby lockboxes and less chance of signal interception by others.

FIG. 1 is schematic view of a representative restricted range lockbox and access key system 100. A lockbox 110 with wireless communications capability is shown in relation to an access device, which in this example is a cellular telephone 120. The restricted range of the lockbox is shown schematically at 130. Thus, the cellular telephone as shown in FIG. 1 is outside of the lockbox's operating range 130, and would need to be moved within the range 130 to communicate with the lockbox 110.

Communications between the lockbox 110 and the cellular telephone 120 may be two-way, as indicated by the two-way arrow representing a communications link 115. In some cases, one-way communication from the cellular telephone 120 to the lockbox 110 may be sufficient.

All of the conventional lockbox functions are supported. Thus, the communications from the cellular telephone 120 to the lockbox 110 would include the ability for the user of the cellular telephone 120 to make an access request directed to the lockbox 110. This access request would include communication of a credential indicating that the user is authorized for access.

In response, the lockbox may communicate a message, either via a display on the lockbox or via a message transmitted to the cellular telephone 120, denying access. Access may be denied, e.g., if the user is unauthorized, if the user's credentials have expired, or if the access privileges have been superseded (i.e., if the property owner has overridden access privileges or is invoking the call before showing feature).

Figure 2:
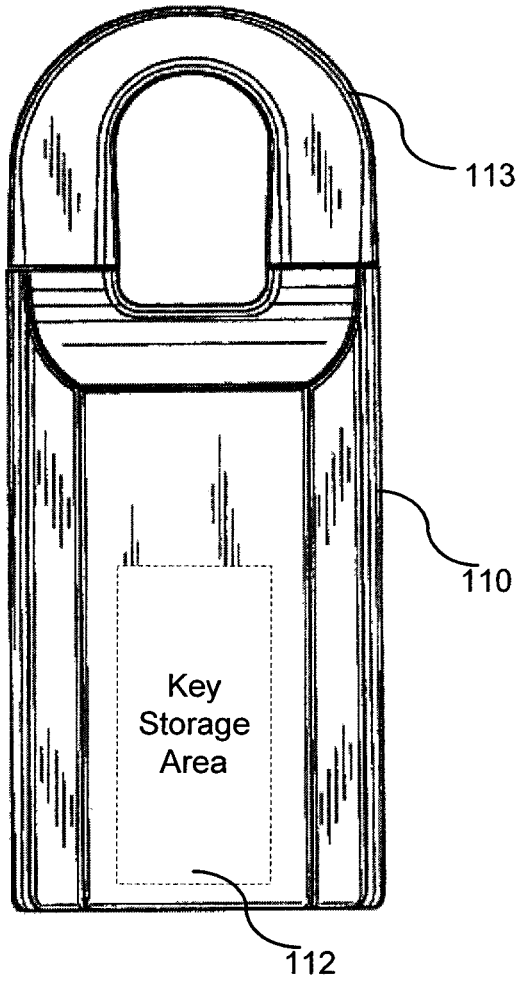
FIG. 2 is a schematic view of a lockbox showing a storage area suitable for holding one or more keys or other access aids.

If access is granted, the lockbox 110 allows the user to gain access to a key storage area 112 (FIG. 2) in the lockbox 110 or open a shackle 113 for removing the lockbox from an object to which it is attached (e.g., a door). In specific implementations, the lockbox has a circuit that controls a lock mechanism that secures the key storage area and shackle in a locked condition when in use. When an access request is granted, the circuit unlocks the lock mechanism to provide the user access to the storage area 112, the shackle, or both.

The lockbox 110 may be a conventional lockbox, such as the GE Security iBox 1692, modified to use restricted range wireless communications, either instead of or in addition to the current IrDa communications capability. The lockbox 110 may be further modified to function with power received from the access device, instead of from a dedicated battery in the lockbox 110. The cellular telephone 120 may be any cellular telephone having restricted range wireless communications capability or other equivalent access device.

Optionally, the system 100 may also include an authorization authority 140, which can be linked to the lockbox 110 (via a link 145), or to the cellular telephone 120 (via the link 150) or to both the lockbox 110 and the cellular telephone 120. The authorization authority can administer granting credentials to users, collect information on usage and activity and provide for updates to devices (lockboxes and access devices) in the system 100.

There are a number of possible ways to implement restricted range wireless communications by which the communicating devices are magnetically coupled. As only one example, the devices can be configured according to the Near Field Communication standards.

Near Field Communication (NFC) is described as a standards based, short range wireless connectivity technology that enables simple and safe two-way interactions among appropriately configured electronic devices. Near Field Communication is based on inductive-coupling, where loosely coupled inductive circuits share power and data over a distance of a few centimeters. NFC devices share some similarities with proximity (13.56 MHz) RFID tags and contactless smartcards, but have a number of new features.

NFC is described as being fast, private and easy as compared to other wireless standards. The NFC set-up time is less than 0.1 millisecond, which is much less than the Bluetooth set-up time of about 6 seconds and less than the IrDa set-up time of about 0.5 second. The NFC operating range is 10 cm or less, which is shorter and provides for more privacy than RFID (operating range up to 3 meters) and Bluetooth (up to 30 meters). At the same time, NFC is more convenient than IrDa which requires line of sight alignment for communication between devices, whereas NFC requires only that the devices be within the NFC operating range of each other. Thus, NFC is one communications technology ideally suited to implementing a restricted range lockbox. In addition, RFID is largely limited to item tracking, and Bluetooth is comparatively more difficult to use because some configuration of the device is required.

NFC operates at 13.56 MHz and transfers data at up to 424 Kbits/second (current data rates are 106 kbps, 212 kbps and 424 kbps). The 13.56 MHz band is not currently regulated, so no license is required. NFC is both a "read" and "write" technology. NFC devices are unique in that they can change their mode of operation to be in reader/writer mode, peer-to-peer mode, or card emulation mode. In reader/writer mode, an NFC device is capable of reading NFC tag types, such as in the scenario of reading an NFC Smartposter tag. The reader/writer mode is on the RF interface compliant with the ISO 14443 and FeliCa schemes. In Peer-to-Peer mode, two NFC devices can exchange data. For example, Bluetooth or Wi-Fi link set up parameters can be shared, and/or data such as virtual business cards or digital photos can be exchanged. Peer-to-Peer mode is standardized on the ISO/IEC 18092 standard. In Card Emulation mode, the NFC device itself acts as an NFC tag (which is a passive device that stores data), appearing to an external reader much the same as a traditional contactless smart card. This enables, for example, contactless payments and eticketing.

Communication between two NFC-compatible devices occurs when they are brought within operating range of each other: a simple wave or touch of a device can establish an NFC connection, which is then compatible with other known wireless technologies such as Bluetooth or Wi-Fi. Because the transmission range is so short, NFC-enabled transactions are inherently secure. Also, the required physical proximity of one device to another is intuitive and gives users the reassurance of being in control of the process.

The underlying layers of NFC technology follow ISO/IEC (International Organization for Standardization/International Electrotechnical Commission, ECMA (European Telecommunications Standards Institute), and ETSI (European Telecommunications Standards Institute) standards. NFC compliant devices in the NFC Reader/Writer mode must support the RF requirements for ISO/IEC 14443A, ISO/IEC 14443 B and FeliCa as outlined in the relevant parts in the ISO 18092. As of this time, there are five published NFC specifications: Smart Poster Record Type Definition (RTD); Data Exchange Format; Record Type Definition; Text RTD and URI RTD. NFC devices are naturally interoperable, as NFC is based on pre-existing contactless payment and ticketing standards that are used on a daily basis by millions of people and devices worldwide. These standards determine not only the "contactless" operating environment, such as the physical requirements of the antennas, but also the format of the data to be transferred and the data rates for that transfer.

Because NFC components are generally smaller, the size of the access device can be kept small, which increases convenience. Also, the size of the lockbox can be reduced.

In some embodiments, the NFC-enabled lockbox can be designed as a passive device that receives its operating power from an NFC access device brought into the NFC operating range of the lockbox. In this way, the battery can be eliminated from the lockbox.

Figure 3:
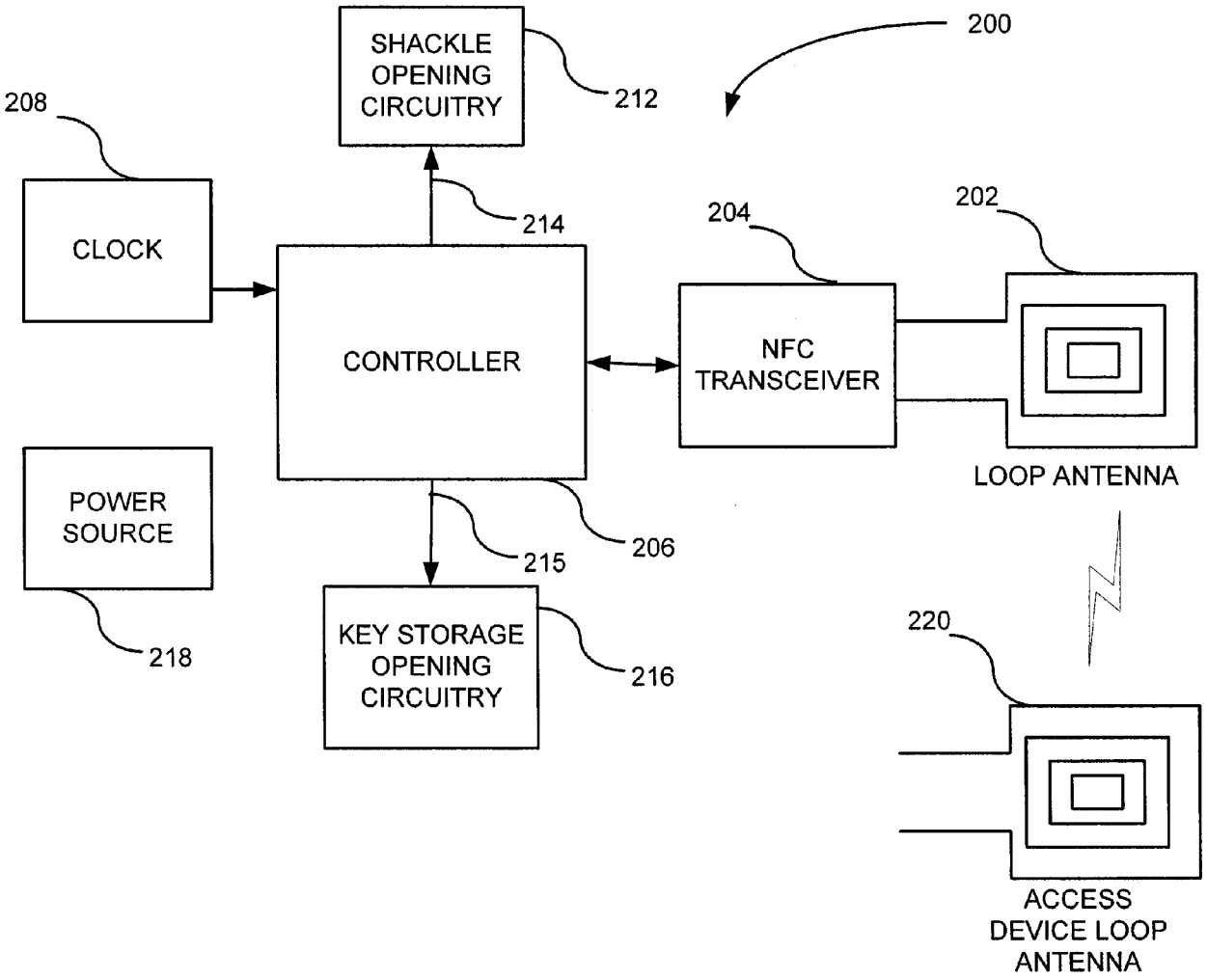
FIG. 3 is an embodiment of a hardware circuit associated with the lockbox and access device of FIG. 1.

FIG. 3 is an embodiment of a hardware circuit that can be used in association with system 100 of FIG. 1. A circuit 200 includes an antenna 202 and an NFC transceiver 204. The antenna operates at 13.56 MHz, but other frequencies can be used. The antenna is an impedance-matching device used to absorb or radiate electromagnetic waves from another signal source. One specific commonly-used type of antenna is called a loop antenna. A loop antenna is closed-circuit antenna meaning that a conductor is formed into one or more turns so that the conductor's ends are close together. A current is then passed through the conductor, which has inductive properties, causing an electromagnetic wave to be radiated. Although the name implies that the antenna shape is round, loop antennas may take many different forms, such as rectangular, square, triangle, ellipse, etc. FIG. 3 shows that the antenna 202 is preferably a loop antenna, in this embodiment. NFC transceivers, such as the one shown at 204, are widely available and any desired NFC transceiver can be used. Example NFC transceivers are available from TOP Tunniste of Finland or Melexis Microelectronic Systems.

The transceiver 204 can be coupled to a controller 206, such as a microprocessor or microcontroller. A clock 208 can be coupled to the controller 206 in a well-known fashion. The controller 206 is coupled to the NFC transceiver for two-way communication there between. The controller can also be coupled to one or more lock opening circuits associated with the lock box that open associated locking mechanisms. For example, a shackle opening circuit 212 opens a locking mechanism of shackle 113 in response to an activation signal 214 from the controller. Likewise, the controller 206 can be coupled to a key storage opening circuit 216 to open a locking mechanism associated with the key storage area 112 in response to activation of a signal 215. The circuits used at 212 and 216 are well-known in the art and generally include charge pumps and capacitors to raise the voltage levels needed to operate the locking mechanisms. A power source 218, such as a battery, can be coupled to all of the components in the circuit 200 needing power, such as the clock 208, the controller 206, and the circuits 212 and 216. The power source 218 may optionally also be coupled to the NFC transceiver 204. Alternatively, the NFC transceiver may obtain power from the loop antenna 202, as described further below. The access device generally also includes an antenna, such as antenna 220. For example, the antenna 220 can be a loop antenna located in the cell phone 120. The antenna 220 is desirably tuned to the same frequency as antenna 202 for high-quality communication there between. The cell phone 120 can also include a transceiver (not shown) that communicates with transceiver 204 via their respective antennas using known protocols.

Figure 4:
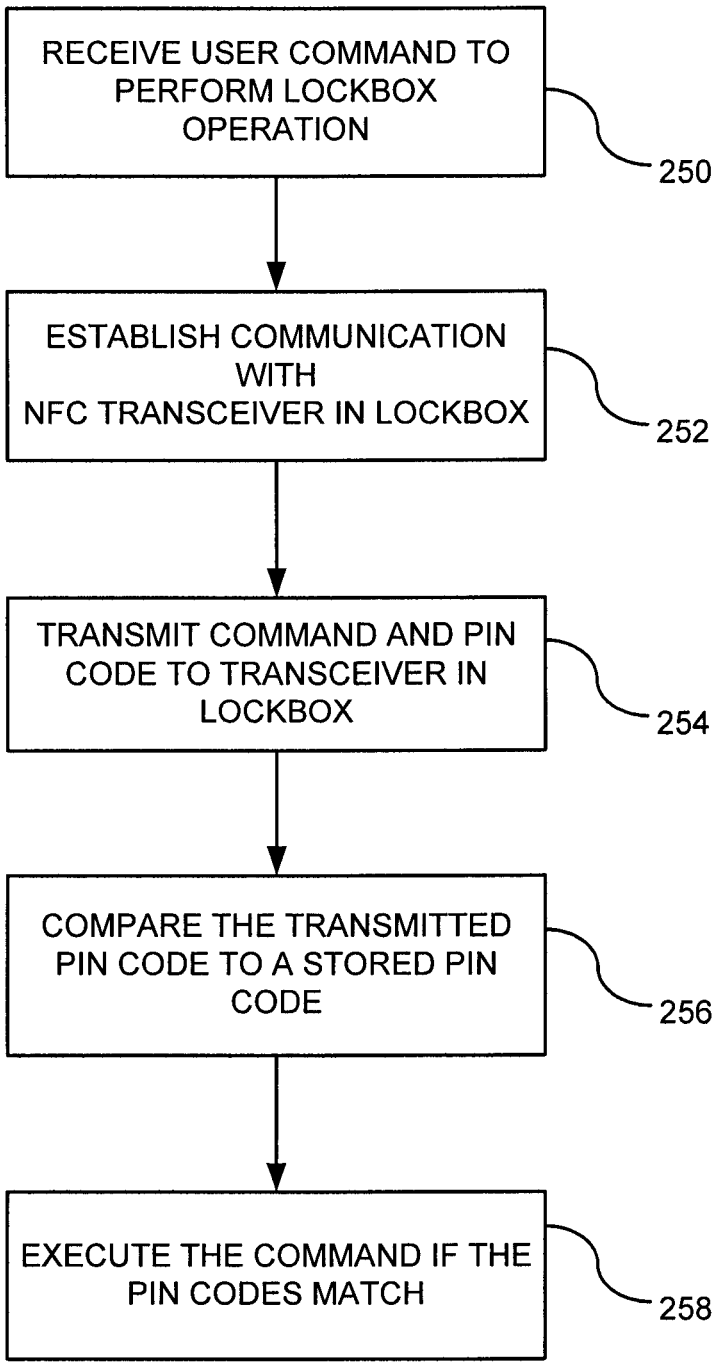
FIG. 4 is an embodiment of a method for executing commands in the lockbox provided from the access device of FIG. 1.

FIG. 4 is a flowchart showing an embodiment of a method for communicating between the access device and the lock box. In process block 250, a user command can be received by the access device. For example, the user can enter a command into the cellular phone 120 indicating the desire to open the shackle 113 or the key storage area 112. In process block 252, the access device establishes communication with the lock box 110 through transmission over an antenna, such as antenna 220. Further details of process block 252 are described below in relation to FIG. 5. Continuing with FIG. 4, the access device communicates the user command to the lockbox 110 via the antennas 202, 220. In the illustrated embodiment, the access device also communicates a pin code to the lockbox. The pin code is used to determine if the access device has authorization to access the lockbox. The pin code may be entered by the user or automatically generated by the access device. In any event, once received by antenna 202, the command and pin code are passed to the transceiver 204. The transceiver 204, in turn, passes the command and pin code to the controller 206. In process block 256, the controller compares the pin code to an acceptable code, which may, for example, be contained on a list of acceptable pin codes stored within the controller 206 or stored in a separate memory (not shown) accessible by the controller. The controller may also receive information regarding the cell phone from which the request was issued to ensure that the pin code is properly associated with the cell phone. In any event, if the pin code is authorized, the controller 206 executes the command by either activating the shackle opening circuit 212 or the key storage opening circuitry 216 for carrying out the user command. Other commands can be added to give the user further lockbox features, such as by opening both the shackle and the key storage simultaneously. In an alternative embodiment, different authorization techniques may be used or the authorization requirement may be deactivated or otherwise not used.

The lock box 110 is generally made of metal or other conductive material, which can interfere with eddy currents in the loop antenna 202 and de-tune the antenna. As a result, it can be beneficial to decouple the antenna from the metal through appropriate insulation or other electrical isolation techniques.

Figure 5:
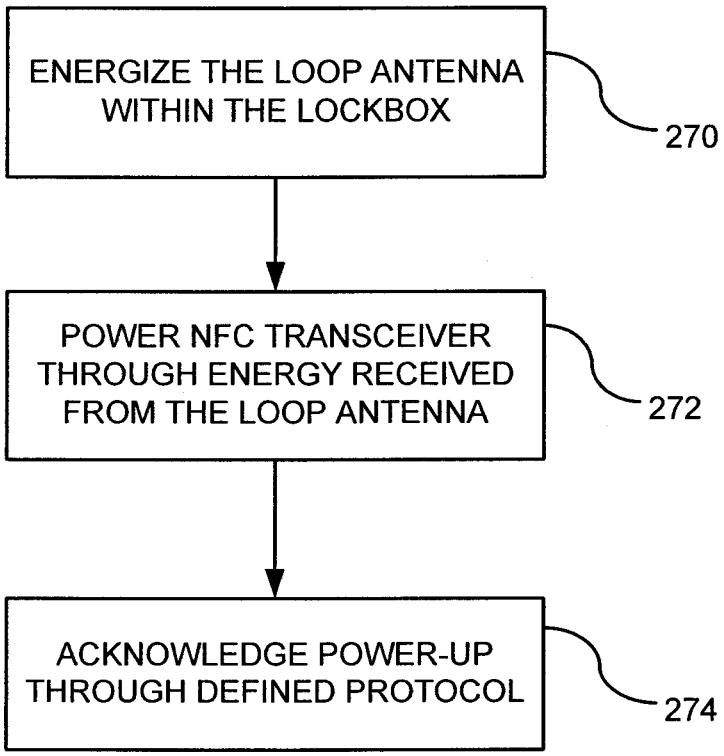
FIG. 5 is an embodiment of a method for establishing communication between the access device and hardware circuitry associated with the lockbox.

FIG. 5 is an embodiment of a flowchart providing further details of process box 252 of FIG. 4. In process block 270, the loop antenna in the access device energizes the loop antenna within the lock box 110 through inductive cross coupling. For example, returning to FIG. 3, the access device uses a local power source (not shown) to energize the loop antenna 220, which when placed in close proximity also energizes antenna 202. Because the loop antenna 202 is energized through inductive coupling, it need not be coupled to the power source 218. Thus, the lock box power source 218 can have a longer life, allowing the lock box to have less maintenance. In process block 272, the power received by the loop antenna 202 on the lock box is used to activate the NFC transceiver. For example, returning to FIG. 3, the loop antenna 202 directly powers the NFC transceiver 204. Thus, in one embodiment, the lock box power source 218 is not coupled to the NFC transceiver to further extend the life of the power source 218. Alternatively, the NFC transceiver may be powered by the power source 218 for faster response time and to reduce the requirement of receiving power through cross coupling of the antennas. In process box 274, once the NFC transceiver 204 is activated, it sends an Acknowledge signal to the access device through loop antennas 202, 220, so that communication can proceed using standard protocols.

In view of the many possible embodiments to which the disclosed principles may be applied, it should be recognized that the illustrated embodiments are only preferred examples and should not be taken as limiting in scope.

The invention claimed is:

1. A lockbox, comprising:

a housing;

a key storage area shaped to receive a stored key, the key storage area being attached to or positioned within the housing and secured with a lock mechanism to prevent unauthorized access to the stored key; and a lockbox circuit comprising a loop antenna, a Near Field Communication (NFC) transceiver and a controller coupled to the NFC transceiver, wherein the NFC transceiver is coupled to receive inductively coupled power and data from the loop antenna, the inductively coupled power and data being received by the loop antenna from a radio access device that can send and receive signals, the lockbox circuit being configured to unlock the key storage area upon determining that an access request from the radio access device is authorized to provide access to the stored key, wherein the lockbox is operational without a battery;

wherein the radio access device is a cellular telephone, the cellular telephone including an access device NFC transceiver and access device loop antenna for communication with the loop antenna and the NFC transceiver of the lockbox.

2. The lockbox of claim 1, wherein the lockbox circuit is configured to receive NFC signals indicating a visitor's identity, to determine whether the visitor is authorized, and to send an unlock signal to the lock mechanism if the visitor is authorized.

3. The lockbox of claim 1, wherein the lockbox circuit is operable when the radio access device is positioned within 30 cm of the lockbox.

4. The lockbox of claim 1, wherein the lockbox circuit is operable when the radio access device is positioned within 15 cm of the lockbox.

5. The lockbox of claim 1, wherein the lockbox further includes a shackle coupled to the housing and wherein the controller is coupled to a key storage opening circuit for opening the key storage area and a shackle opening circuit for opening the shackle.

6. A lockbox and access device system, comprising:

a lockbox with a key storage area shaped to store a key, a lock mechanism actuatable to secure the key storage area, a circuit coupled to the lock mechanism and responsive to Near Field Communication (NFC) wireless signals at a frequency of 13.56 MHz within a near field region of 10 cm or less from the lockbox, the lockbox including a loop antenna, a Near Field Communication (NFC) transceiver and a controller coupled to the NFC transceiver, wherein the NFC transceiver is coupled to receive inductively coupled power and data from the loop antenna, wherein the lockbox is operational without a battery;

a cellular telephone including an access device NFC transceiver and access device loop antenna for communication with the loop antenna and the NFC transceiver of the lockbox by magnetically inducing a current within the circuit to request access to the key storage area; and a networked authorization authority linkable with the cellular telephone to receive information about a user of the cellular telephone and to send an authorization to the cellular telephone.

* * * * *